United States Patent [19]

Eliason

[11] Patent Number: 4,937,106

[45] Date of Patent: Jun. 26, 1990

[54] COLLAPSIBLE DECROATIVE ASSEMBLY

[75] Inventor: Rebecca S. Eliason, Lakewood, Ohio

[73] Assignee: American Greetings Corporation, Cleveland, Ohio

[21] Appl. No.: 360,324

[22] Filed: Jun. 2, 1989

[51] Int. Cl.[5] ..... A41G 1/00; D04D 7/10

[52] U.S. Cl. ..... 428/4; 28/147; 28/150; 428/9; 428/24

[58] Field of Search ..... 428/4, 5, 9, 12–24; 28/147, 150

[56] References Cited

U.S. PATENT DOCUMENTS

| | | | |
|---|---|---|---|
| 1,621,703 | 3/1927 | Adams | 428/9 |
| 1,809,593 | 6/1931 | Luhrs | 428/9 |
| 2,704,904 | 3/1955 | Maas | 428/9 |
| 2,792,655 | 5/1957 | Kroxzynski et al. | 428/4 |
| 3,143,259 | 8/1964 | Paar | 428/5 X |
| 3,668,796 | 6/1972 | Patteson | 428/9 |
| 3,728,201 | 4/1973 | Stroehmer | 428/9 |
| 4,627,640 | 12/1986 | Markovics | 428/4 X |

*Primary Examiner*—Henry F. Epstein

*Attorney, Agent, or Firm*—Baldwin, Egan & Fetzer

[57] ABSTRACT

The invention relates to a collapsible decorative assembly and method for making the same, wherein a plurality of foldable elements are positioned adjacent one another such that they may be collapsed and opened in conjuction with one another. The elements have ornamental shaped portions and are folded so as to form inwardly folded regions which enable the elements to be positioned in an interconnected manner. Exterior surfaces formed in the elements by the folding are secured to one another in a predetermined manner to provide collapsible assembly which is opened for use as a decorative bow or the like.

19 Claims, 10 Drawing Sheets

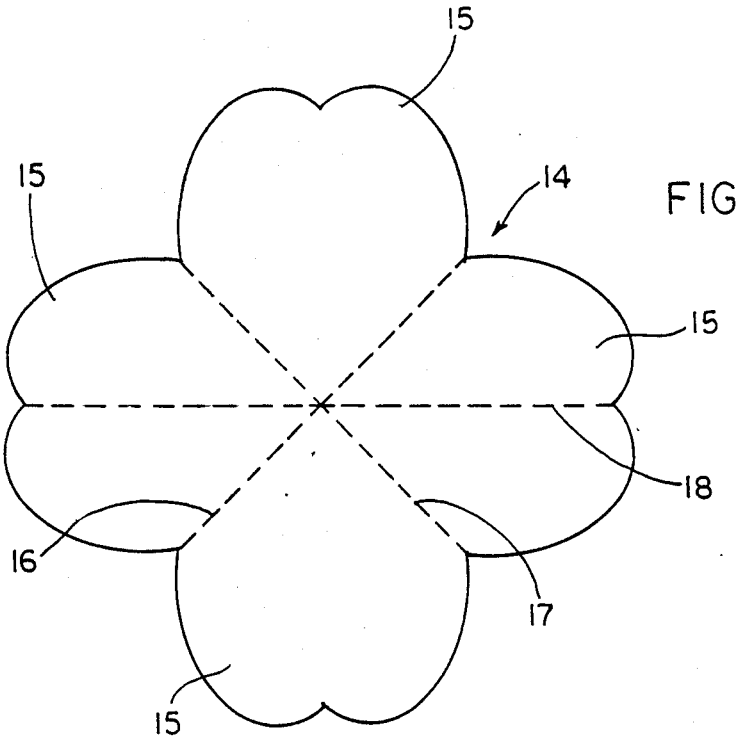
FIG 2
FIG 3
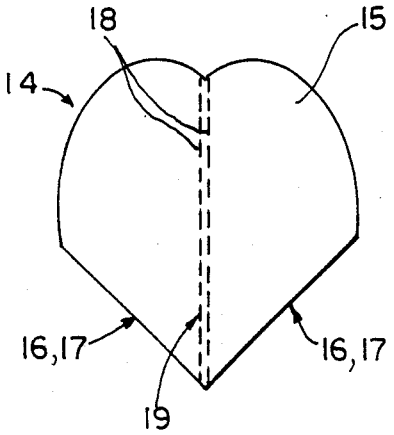
FIG 4
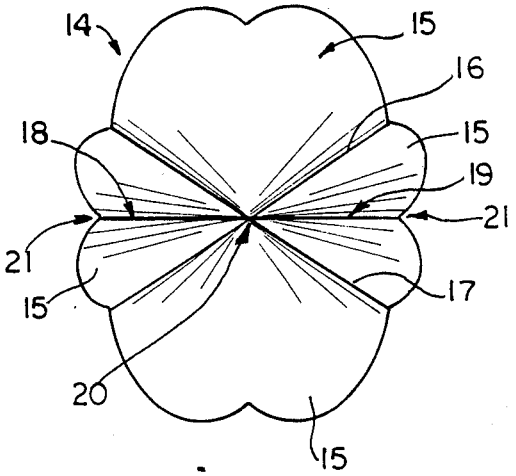

COLLAPSIBLE DECROATIVE ASSEMBLY

BACKGROUND OF THE INVENTION

This invention relates to a collapsible decorative assembly for use on packages and the like and the method of producing the decorative assembly. More particularly, the invention relates to a decorative bow for use on gifts or other packages which may be collapsed to a flat position for the convenient packaging and distribution to the consumer without harming the decorative assembly.

Various types of folding ornaments or the like have been conceived in the prior art, some of which comprise a tissue paper or the like being folded into a honeycomb and shaped into an ornamental configuration. The honeycomb structure is then secured to a pair of face members enabling the structure to be collapsed to a closed position and opened to form an ornament having a desired shape. Examples of these structures may be found in U.S. Pat. Nos. 1,621,703, 1,809,593, and 2,704,904. As can be seen in these previous patents, the construction of the ornaments or other novelties include means enabling a structure to be retained in an open position or to stand upright into a desired position.

Other known ornament or decorative assemblies include a plurality of interconnected loops or the like formed from ribbon or other material to yield a decorative bow or other ornament. Examples of these structures may be found in U.S. Pat. Nos. 2,792,655 or 3,143,259 showing the method of forming these assemblies as well as their unique appearance.

Still other decorative assemblies have been constructed of a singular sheet or plurality of sheets having scored lines thereon for folding the decorative assembly. In these constructions, the decorative assemblies may be conveniently flat for distribution and subsequently folded into a three dimensional ornament for use. Examples of such constructions may be found in U.S. Pat. Nos. 3,728,201 and 3,668,796. It should be recognized in these constructions that the resulting decorative assembly may only be obtained by subsequent folding and/or securing of the sheet or sheets in the construction. These constructions are somewhat disadvantageous as they are not conveniently and easily used by a consumer. Similarly, these constructions are limited to a great degree in the flexibility of design and appearance as well as the imposition on the consumer of constructing the final assembly.

SUMMARY OF THE INVENTION

In view of the prior art ornamental assemblies similar to those previously described, it has been found desirable to provide a decorative assembly having features which combine the unique appearance of the decorative bows made from a ribbon or similar material with the advantages gained by enabling the resulting assembly to the folded to a closed position for packaging and distribution to the consumer. The ornamental structures in the prior art which are capable of being folded to a closed position have lacked the unique appearance and strength of decorative bows or the like formed from ribbon or other suitable material having resilient or flexible characteristics and giving a unique appearance.

It is therefore one object of the present invention to provide a decorative assembly which is highly aesthetic in appearance and which is collapsible to a closed position for packaging and distribution thereof.

It is a further object of the invention to provide a decorative assembly and method of forming the assembly wherein the resulting assembly may be varied as desired to form a decorative bow, Christmas ornament, or other similar decorative assembly.

It is yet another object of the invention to provide a decorative assembly which is collapsible for packaging and distribution thereof, and which may be opened to expand circumferentially and form a decorative floral-type assembly which may be secured to a package or the like, or to itself to provide a decorative ornament.

A decorative assembly and method of forming the assembly which has the unique characteristics of being collapsible are provided for convenient packaging and distribution and which forms a unique assembly for use by a consumer. The method of forming the collapsible decorative assembly of the invention includes forming a plurality of foldable elements from a flat sheet, each of which includes generally symmetrically positioned ornamental extensions or shaped portions in the flat sheet. The individual elements are subsequently inwardly folded in a first direction so as to position adjacent ones of the shaped portions in overlapping relationship. Similarly, the elements are also folded inwardly in a second direction generally perpendicular to the first direction to effectively separate each of the ornamental extensions by an inward fold line. The element is then outwardly folded upon itself along a line bisecting diametrically opposed shaped portions such that the resulting fold lines enable the elements to be folded upon themselves with inwardly folded regions formed at the location of the outward fold lines.

With individual elements constructed in this manner, a plurality of elements are then positioned adjacent one another with at least one of the inwardly folded regions placed within one of the inwardly folded regions of an adjacent element. By folding and positioning ob the individual elements in this manner, a rosette or other decorative assembly may be formed which is collapsible to a closed position for packaging and distribution and which may be opened to reveal a decorative assembly for use as a bow on a package, Christmas ornament or the like.

The construction achieved by the method as described yields a collapsible decorative assembly having the unique characteristics of being foldable to a flat position for packaging and distribution while providing a unique flower-like appearance when opened for use as a decorative bow or ornament. For example, two of the rosettes formed in the manner described may be secured to one another such that they are foldable to open and closed positions simultaneously and may be opened to provide a decorative bow which lies on a flat surface such as a package or present. Similarly, additional rosettes may be provided such that a substantially circular ornament is formed wherein opposite sides of the assembly may be secured to one another rather than to another object.

In preferred embodiments, the individual foldable elements are secured to one another by means of an adhesive for securing certain exterior regions of the foldable elements to one another thereby enabling opening of each individual element in the formed rosettes. Similarly, the bottom faces of the formed rosettes may include adhesive tabs for fastening to a surface thereby making use of the decorative assembly particularly convenient and easy. It should be recognized that the decorative assembly formed in the manner of the present invention provides the desired characteristics of being foldable to a closed position for packaging and distribution as well as providing a unique appearance of a decorative bow made from a ribbon or similar material. The decorative assembly as well as the method of producing the assembly is simple and cost effective and yet yields a very aesthetically pleasing appearance.

BRIEF DESCRIPTION OF THE DRAWINGS

These and other objects of the invention will become apparent from a review of the drawings and detailed description of the invention wherein:

FIG. 2 is a plan view of a foldable element utilized in the decorative assembly;

FIG. 3 is a plan view of the foldable element as shown in FIG. 2 in its folded completely closed position;

FIG. 4 is a top plan view of the foldable element of FIGS. 2 and 3 but shown in a folded but open position;

DETAILED DESCRIPTION OF THE INVENTION

Figure 1:
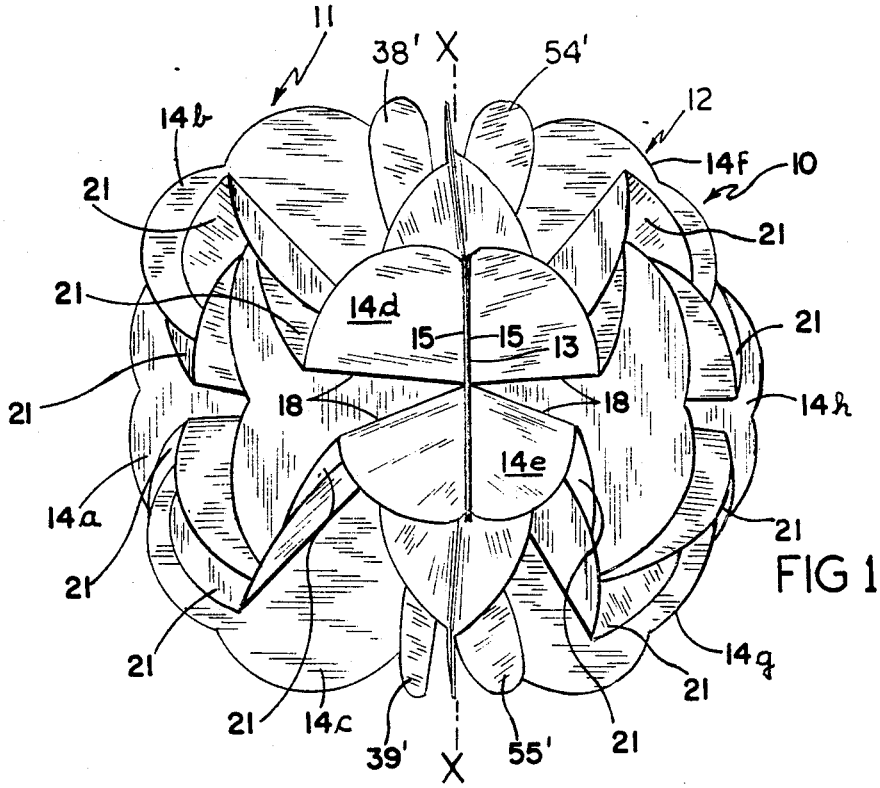
FIG. 1 is a top plan view of the preferred embodiment of the invention shown in its open position for use.

Referring now to the drawings, FIG. 1 shows a preferred embodiment of the invention wherein several rosettes formed from individual foldable elements are secured to one another to form a decorative bow. The assembly is constructed so as to be placed on a flat surface such as a package or the like. The decorative assembly 10 essentially comprises two halves or rosettes 11 and 12 which are identical to one another so as to form a symmetric and aesthetically pleasing decorative assembly when combined. Each of the rosettes 11 and 12 is constructed of a plurality of individual foldable elements 14 which are positioned adjacent one another and secured so as to open and close in conjunction with one another. As will be described in more detail later, each of the rosettes 11 and 12 may comprise four separate foldable elements each of which has symmetrically positioned ornamental shaped portions on its periphery. In the preferred embodiment as shown in FIG. 1, the symmetrically positioned shaped portions are formed like the petals of a flower such that when in the open position there is formed an aesthetically pleasing decorative assembly which resembles a flower.

It should be recognized that other symmetrically positioned shaped portions or ornamental extensions may be provided to give the decorative assembly a different appearance from that shown in the Figures. Similarly, the individual foldable elements 14 include four symmetrically positioned shaped portions such as petals but may comprise additional symmetrically positioned shaped portions to yield a different appearance as is desired.

Figure 1A:
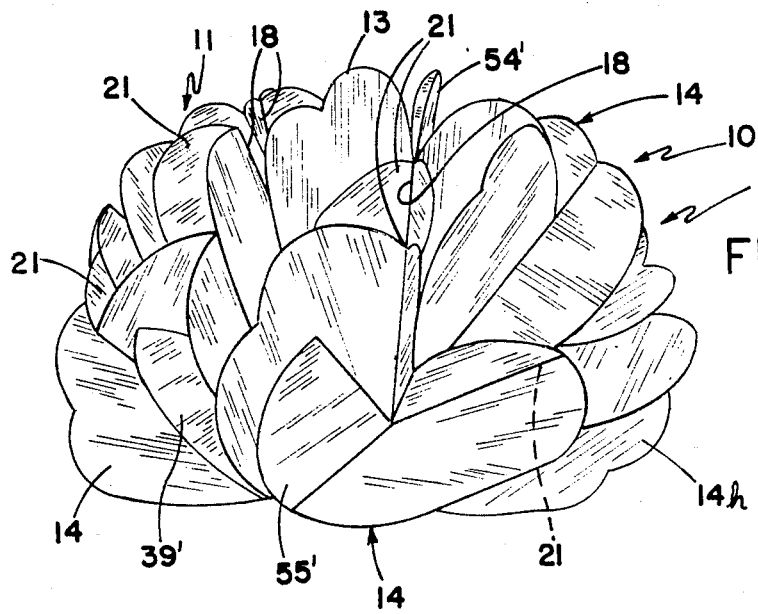
FIG. 1*a* is a perspective view of the open decorative assembly as shown in FIG. 1.

Each of the rosettes 11 and 12 comprise four separate foldable elements which are positioned adjacent one another and secured so as to allow the elements forming the rosette to open and collapse in conjunction with one another. The separate foldable elements 14 are also secured to one another at predetermined locations so that when the rosette is placed in its open position the separate foldable elements will be opened to provide the desired appearance. As can be seen in FIGS. 1 and 1*a*, the decorative assembly may be formed by placing two of the rosettes in side by side relationship yielding an assembly having a flower-like appearance with a multiplicity of petals extending in all directions.

An understanding of a construction of the decorative assembly 10 may be had with reference to FIGS. 2–5. In FIG. 2 there is shown one of the foldable elements 14 utilized in the construction of a decorative assembly.

The element 14 comprises symmetrically positioned shaped portions 15 around its periphery which when folded in the manner of the invention provide a flower-like appearance. The decorative assembly is constructed of a plurality of elements 14 which are folded in a particular manner and secured so as to make the construction simple and give the desired appearance. In the method of forming a collapsible decorative assembly, the elements 14 may be first inwardly folded along the line 16 so as to position adjacent ones of the shaped portions 15 in overlapping relationship. Subsequently, the element 14 may be inwardly folded in a second direction generally perpendicular to the first direction along line 17 to again position adjacent ones of the shaped portions in overlapping relationship. As can be seen in FIG. 2, the inward folds 16 and 17 essentially bisect the element 14 into four equal portions wherein each of the shaped portions 15 is essentially separated by the fold lines 16 and 17. At this point in the construction, the element 14 may be outwardly folded along a line bisecting diametrically opposed shaped portions along the line 18. It should be evident that the order in which the folds 16, 17 and 18 are completed is not critical to the invention.

With the fold lines 16, 17 and 18, it should be recognized that the element 14 may then be folded upon itself or collapsed such that two diametrically opposed shaped portions 15 are positioned in overlapping relationship while the other two shaped portions 15 will be inwardly folded due to fold line 18. In FIG. 3, which is an illustration of the element 14 of FIG. 2 in the aforementioned collapsed condition; the fold lines 16, 17 and 18 allow the element 14 to be folded upon itself to the shape of one of the individual shaped portions 15. The outward fold line 18 allows the shaped portions 15 which it bisects to be folded into adjacent relationship as shown at 19. This creates inwardly folded regions 21 (FIG. 4) in the folded element 14 which allow a plurality of the folded elements to be placed adjacent to one another in an interconnected fashion.

As seen in FIG. 4, the separate foldable element 14 is shown in a folded condition as compared to the condition of element 14 shown in FIG. 2, but in a somewhat open condition as compared to the condition illustrated in FIG. 3, and wherein in such somewhat open condition the inward fold lines 16 and 17 allow diametrically opposed shaped portions 15 to extend upwardly and outwardly from center point 20 of the element 14. The outward fold line 18 allows the other diametrically opposed shaped portions 15 to be folded inwardly towards the center 20 such that the aforementioned inwardly folded regions 21 are formed in folded element 14.

Figure 5:
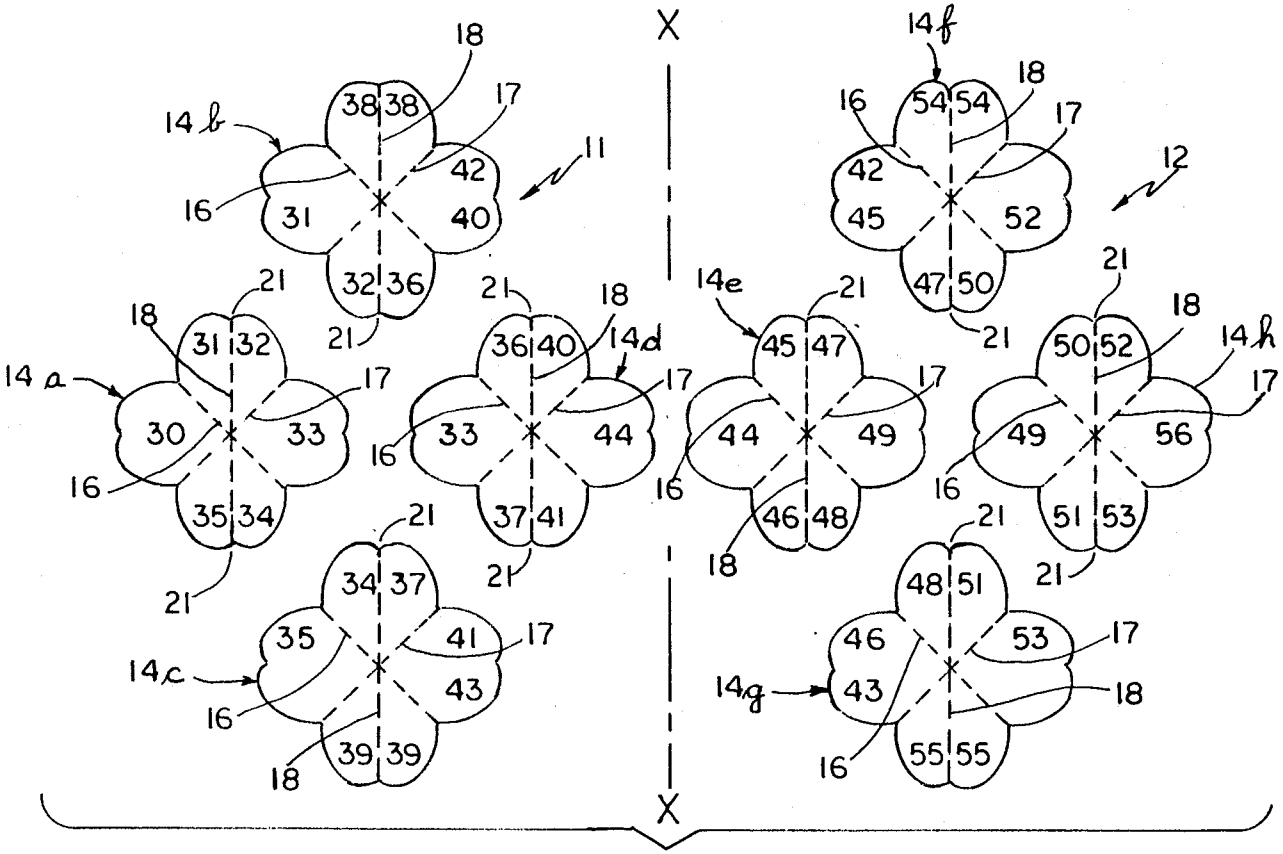
FIG. 5 is an exploded view illustrating a plurality of reduced size foldable elements of FIG. 2 showing a construction of the decorative assembly.

Turning now to FIG. 5, the construction of the decorative assembly as shown in FIG. 1 is more particularly described with respect to the individual foldable elements 14.

As mentioned previously, the decorative assembly 10 as shown in FIG. 1 is constructed of a plurality of foldable elements 14 which are formed into collapsible rosettes. In FIG. 5, the foldable elements 14 are shown with fold lines as described with reference to FIG. 2 shown therein. Each of the foldable elements 14 in FIG. 5 comprises shaped portions as previously described and are arranged in a particular manner for forming the collapsible decorative assembly.

Each of the foldable elements 14 (respectively referred to with a letter added to the references No. 14, for identification purposes), is secured to an adjacent foldable element by means of exterior faces formed by the fold lines of each element. The interior surfaces of the latter mentioned faces have been indicated by reference numbers within each element 14 and wherein like reference numbers indicate that these particular surfaces on the reverse side (i.e. exterior face) thereof are secured to one another. For example, the reverse sides of the interior surfaces 31 and 32 on folded element **14*a* comprise the exterior faces of the inwardly folded region 21 formed therein as previously described. These exterior faces (i.e. the reverse side of each interior surface 31, 32) on element 14*a* are secured respectively to the exterior faces (i.e. the reverse sides of interior surfaces 31 and 32 of element 14*b* as shown in FIG. 1, and such that the inwardly folded region of element 14*a* is placed within the inwardly folded region of element 14*b* at surface 32. Similarly, the reverse side (i.e. exterior face) of interior surface 36 on the inwardly folded region of element 14*b* is secured as for instance by adhesive, to the reverse side of interior surface 36 of element 14*d* which also forms part of the inwardly folded region 21 in element 14*d***.

It should be noted that folded elements **14*a*–14*d* when assembled with one another comprise what may be considered or referred to as an individual rosette (e.g. 11-FIG. 1) formed from a plurality of the foldable elements and folded in the manner previously described. In this rosette it is also indicated that the reverse side (i.e. exterior face) of interior surface 33 of element 14*a* and the reverse side of interior surface 33 of element 14*d* are secured, as by an adhesive; to one another, such that all of the elements 14*a*–14*d* will be positioned adjacent one another in an interconnecting manner. It is also to be noted that folded elements 14*b* and 14*c* include respectively interior surfaces 38 and 39 which reverse sides (i.e. exterior faces) thereof may be secured as for instance by adhesive on the respective reverse sides to one another, such that upon opening of the collapsible assembly these secured portions (referred to by reference numbers 38' and 39' respectively in FIG. 1) are symmetric and facilitate proper opening of the elements to provide the desired appearance to the resulting rosette. It is also noted that the exterior faces of inwardly folded regions defined by interior surface 32, 36 and 34, 37 of elements 14*b* and 14*c* respectively are secured to both of the elements 14*a* and 14*d* respectively at the exterior faces (reverse sides) of the correspondingly numbered interior surfaces thereof. Similarly, the exterior faces of interior surfaces 31 and 40 of element 14*b* and the exterior faces of interior surfaces 35 and 41 of element 14*c*** indicated by use of the same reference number that these shaped portions are secured to a portion of the inwardly folded regions on an adjacent element.

By securing the surfaces in the manner shown, the rosette takes on an aesthetically pleasing appearance upon assuming its open position. Because the decorative assembly may be constructed of a strong but resilient or flexible material such as ribbon or paper or any other suitable material, the secured surfaces and unsecured surfaces (where no identical reference number appears thereon) allow each of the individual foldable elements 14 to assume a shape similar to that shown in FIG. 4 when the decorative assembly 10 is in an open condition such as shown in FIG. 1.

It will also be apparent from FIG. 5 that a plurality of rosettes (i.e. 11 and 12) formed in the manner described, may be secured to one another along a vertical center plane X—X to provide a desired decorative assembly. The assembly shown in FIG. 1 includes two rosettes 11 and 12, each comprising four foldable elements **14*a*–14*d* and 14*e*–14*h* respectively which are secured along plane X—X. As seen in FIG. 5, the exterior face (i.e. reverse side) of interior surface 44 of element 14*d* is secured as for instance by adhesive to surface 44 of element 14*e*. Also, exterior faces of interior surfaces 42 and 43 respectively of elements 14c and 14d are secured respectively to similar exterior faces of correspondingly numbered interior surfaces on elements 14f and 14g respectively. In this way, the two rosettes 11 and 12 are secured to one another about plane X—X and along confronting faces thereof as referred to by reference numeral 13 in FIG. 1. The two rosettes will then open out from this plane to form the decorative assembly as shown in FIG. 1. Also shown in FIG. 5 and identified by corresponding numbers are the interior surfaces formed by the aforementioned fold lines and defining the exterior surfaces on elements 14e–14h which are positioned adjacent one another in an interconnected fashion and in a similar manner as afore described in connection with the rosette 11 (foldable elements 14a–14d**).

It should be recognized that the folding of each separate element into the shape illustrated for instance in FIG. 3, as well as the positioning and securing of the individual folded elements into the interconnecting adjacent relationship shown in FIGS. 1, 1a, 7 and described in connection with FIG. 5, is relatively simple and may be accomplished by means of automated equipment. Thus, the resulting decorative assembly is both cost effective and provides the advantages of being collapsible into a flattened condition as shown in FIG. 6, for packaging and distribution, and when opened as shown in FIGS. 1 and 1a, providing an aesthetically pleasing appearance to the consumer.

Figure 6:
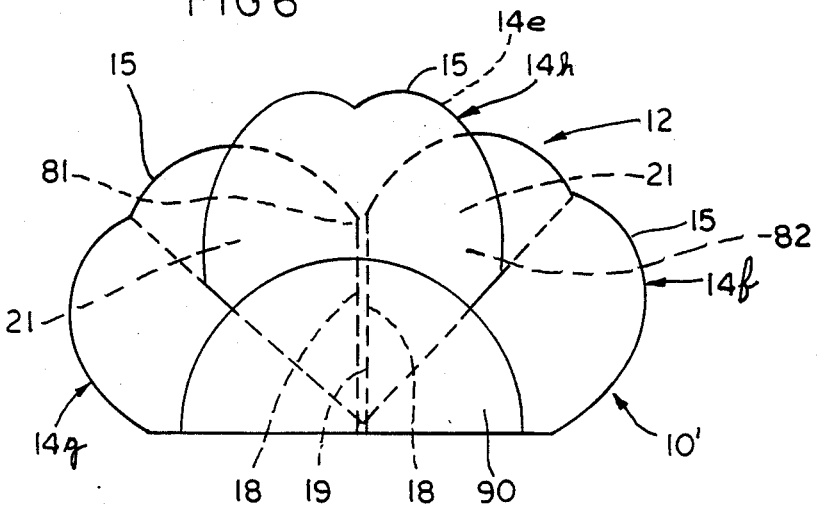
FIG. 6 is a side elevational view of a decorative assembly shown in its closed position.

The combined foldable elements forming the collapsible decorative assembly are shown as aforementioned in FIG. 6 wherein the decorative assembly 10 is shown in its completely collapsed position or condition. The separate foldable elements 14 are positioned as shown wherein at least one of the inwardly folded regions of each of the foldable elements is located within one of the inwardly folded regions of an adjacent element as described in connection with FIG. 5. In this way, the separate foldable elements are able to be opened and collapsed in conjunction with one another as is desired. As seen in FIG. 6, the rosette 12 in the decorative assembly 10 may be formed by the positioning of two (e.g. elements 14e and 14h) of the separate foldable elements in an adjacent relationship at the center of the structure as shown. A third and a fourth foldable element (e.g. 14f and 14g) are positioned on opposed edges of the two adjacent elements 14e and 14h as shown. The elements 14f and 14g respectively have inwardly folded regions positioned in an adjacent one of the inwardly folded regions 21 of the two adjacent elements 14e and 14h respectively, as shown for instance at 81 and 82. It is also seen from FIG. 6 that the third and fourth elements 14f and 14g are positioned at an angle relative to the vertical centerplane of the adjacent elements at 14e and 14h such that a linear edge is provided at the lower boundary of assembly 10. This angled positioning of the third and fourth elements 14f and 14g of each rosette allows the decorative assembly to achieve the full appearance of a flower and also gives a symmetric appearance to the opened rosettes forming the decorative assembly.

As seen in FIGS. 1, 1a, 5 and 7 the decorative assembly 10 comprises two rosettes 11 and 12 formed in the manner previously described. The two rosettes are secured to one another at the surfaces described in connection with FIG. 5, but may also include an adhesive tab 90 connecting between rosettes 11 and 12 to ensure the proper retention of rosettes 11 and 12 in an adjacent relationship. There may also be provided adhesive tabs 91 and 92 on the outer bottom surfaces of each rosette which may be utilized to secure the open decorative assembly to a package or other object. The adhesive tabs 91 and 92 may include release liners such that they may be peeled for use by the consumer.

Figure 7:
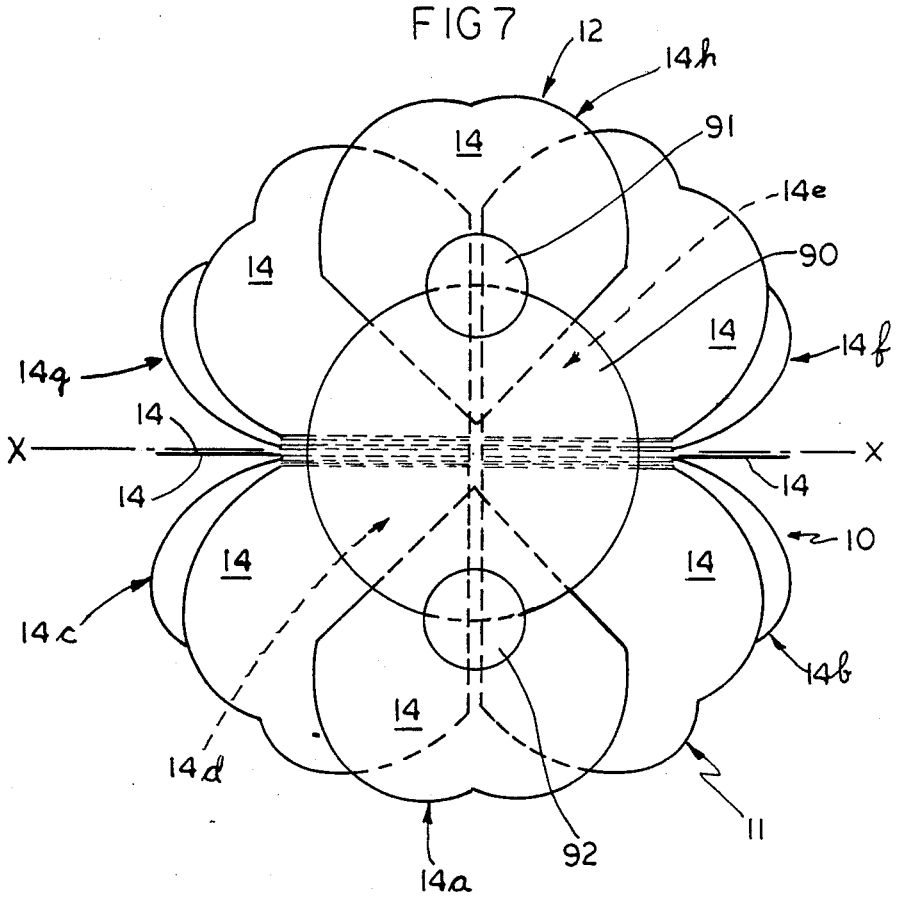
FIG. 7 is a bottom plan view of a preferred embodiment of the decorative assembly of FIG. 1, shown in its open position.

As can be seen from FIGS. 6 and 7, by securing two rosettes in an adjacent relationship as shown, the resulting assembly may be opened 180 degrees so as to lie on a flat surface with tabs 91 and 92 mounting the decorative assembly in its open condition on such flat surface, such as for instance on a package. It is easily recognized that the configuration may be changed to accommodate a particular surface or may include additional rosettes so that the resulting assembly could be opened 360 degrees and attached to itself forming a decorative ornament or the like.

Figure 8:
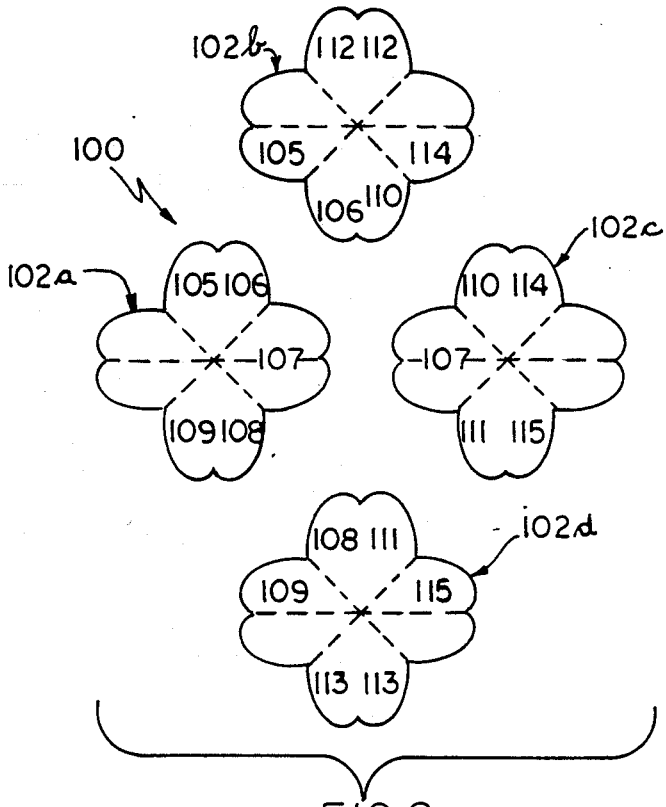
FIG. 8 is an exploded plan view illustrating alternate embodiment of the invention showing a plurality of reduced sized foldable elements and the construction of the alternative decorative assembly.

Turning now to FIG. 8, an alternate embodiment of the invention may be constructed from a four petal or unit configuration to achieve a decorative assembly having a unique and different appearance from that previously described. The configuration will essentially be half of the eight petal configuration as shown in FIG. 1, which will enable further opening of the discrete individual foldable elements making up the assembly, if it is desired to place the assembly on a flat surface.

As shown in FIG. 8, a four unit configuration 100 is constructed from four foldable elements 102a–102d being secured to an adjacent foldable element by means of exterior faces formed by the fold lines of each element. The interior surfaces of the exterior faces have been indicated by reference numbers within each element 102, wherein like reference numbers indicate that these particular exterior faces are secured to one another. Similarly to that shown in FIG. 5, the exterior faces of the referenced interior surfaces of the individual foldable elements 102a–102d are secured to the respective exterior faces having similar reference numerals to form the four petal rosette of this embodiment. Thus, the individual foldable elements, 102a–102d will have respective indicated exterior surfaces thereof secured to one another such that all of the elements 102a–102d will be positioned adjacent to one another in an interconnecting manner.

Upon opening of the collapsible assembly formed in the manner of FIG. 8, the secured exterior faces of the individual elements 102a–102d will form a symmetric and properly opening decorative assembly to yield the desired appearance to the resulting rosette. As fewer individual elements are utilized in the formation of the decorative assembly in this embodiment, the individual elements 102a–102d can be opened to a greater extent if the assembly is to be used on a flat surface.

Figure 9:
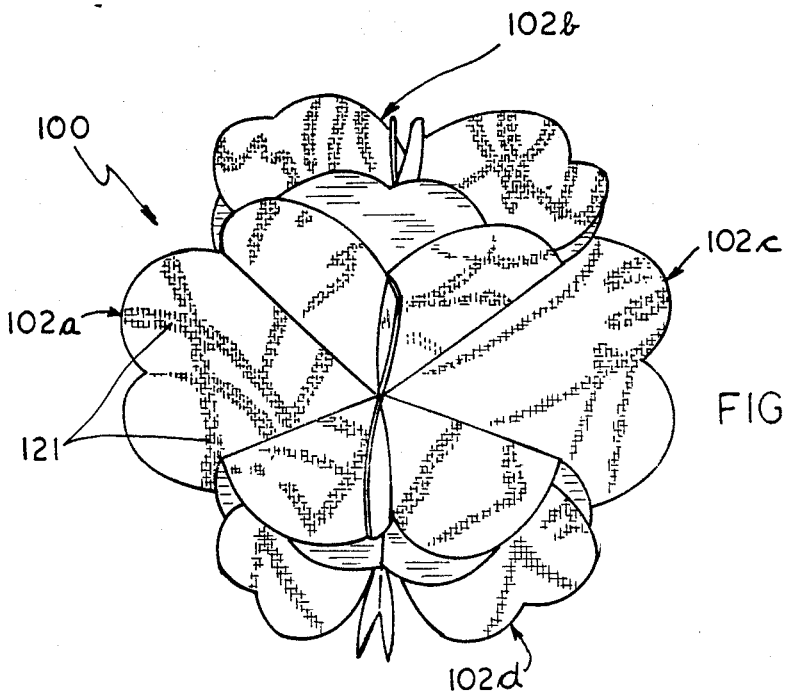
FIG. 9 is a top plan view of the constructed decorative device of the embodiment as shown in FIG. 8, shown in its open position for use, and including a decorative pattern on is upward surfaces to yield a distinctive appearance to the assembly.

Alternatively, the assembly could be positioned so as to open 90° for special applications. As seen in FIG. 9, the individual foldable elements 102a–102d may be provided with decorative enhancements 121, which may be different designs on the individual foldable elements themselves or which may be achieved by assembling individual foldable elements formed from different materials.

Figure 10:
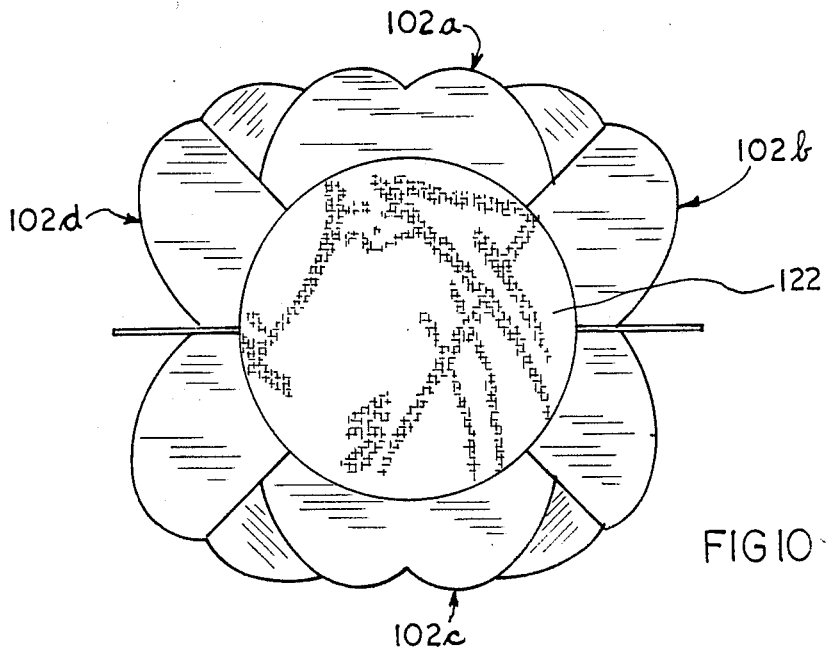
FIG. 10 is a bottom plan view of the embodiment of the decorative assembly shown in FIG. 9, shown in its open position.

As seen in FIG. 10, the individual foldable elements 102a–102d may also be secured to one another by means of an adhesive tab 122 similar to that shown in FIG. 7. Although not shown in FIG. 10, there may also be provided adhesive tabs on the outer bottom surfaces of the assembly which may be utilized to secure the open decorative assembly to a package or other object as previously described.

Figure 11:
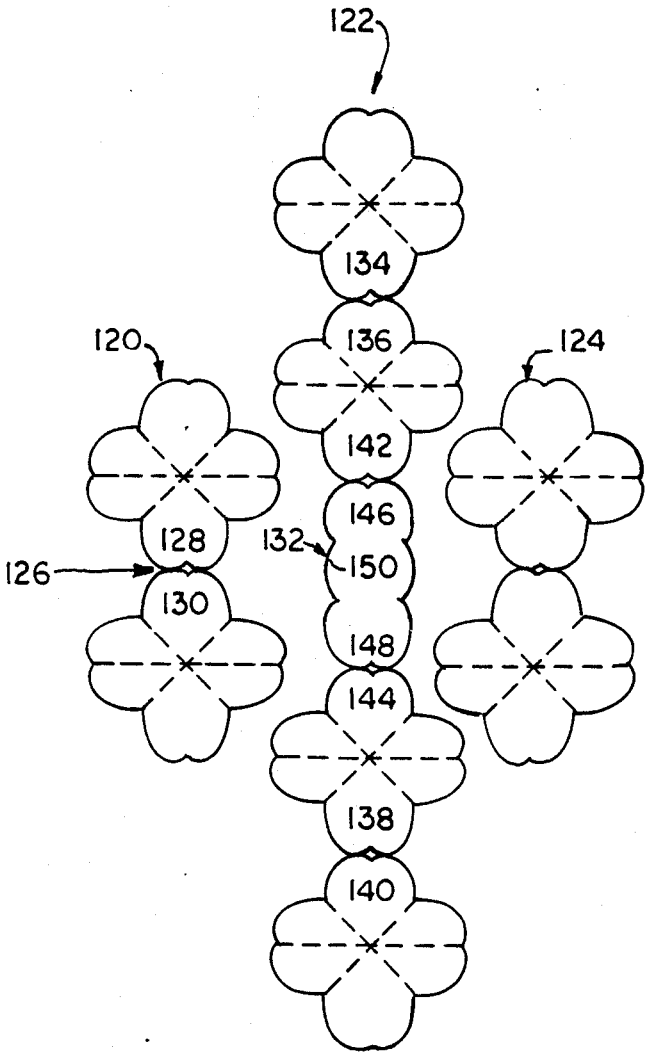
FIG. 11 shows an alternate embodiment of the invention showing an eight unit decorative assembly similar to that shown with respect to FIGS. 1 and IA, but being formed from continuous web unit formations rather than discrete die-cut individual units to form the assembly.

Turning now to FIG. 11 there is shown an alternate embodiment of constructing the collapsible decorative assembly of the invention. As seen in FIG. 11, an eight unit assembly comprises three discrete web elements 120, 122 and 124 which include a plurality cf foldable elements die-cut from a continuous web of material so as to be attached to one another as shown. For the eight petal configuration of the assembly, the elements 120 and 124 comprise two foldable elements. The elements will be separately folded as previously described and connected at location 126 such that the exterior faces of portions 128 and 130 will be folded upon themselves. The web element 124 will be similarly folded to form the elements which will be inserted from the sides of the assembly similar to elements 14*b*, 14*c*, 14*f* and 14*g* as seen in FIG. 5. The web unit 122 comprises four foldable elements formed from a continuous web. The elements attached to one another as shown and have an integral connecting portion 132 associated therewith. The individual foldable elements of the web unit 122 will be folded as previously described such that the exterior faces 134 and 136 as well as 138 and 140 will be folded upon one another in the folded position. Similarly, the exterior faces 142 and 144 will lie flush with portions 146 and 148 of the integral base portion 132 leaving a portion 150 which acts as a connecting base similar to element 90 of FIG. 7.

Figure 12:
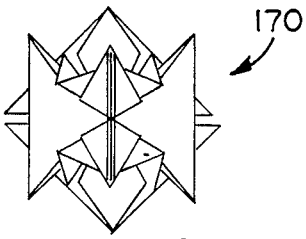
FIG. 12 shows an alternate embodiment of the invention having a different outer configuration by adjusting the shape of the unit exteriors, wherein, in this embodiment the exteriors are generally triangularly shape.
Figure 13:
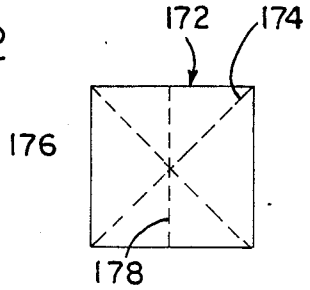
FIG. 13 is a plan view of a foldable element utilized in the decorative assembly as shown in FIG. 12.

An alternate embodiment of the decorative assembly is shown in FIG. 12 at 170. The foldable elements of the assembly have triangularly shaped ornamental portions on the peripheries to form a unique and different appearance. The decorative assembly 170 is constructed from individual foldable elements 172 as seen in FIG. 13. The foldable element 172 includes inward folds 174 and 176 as well as outward fold 178 similar to the petal configuration as shown in FIG. 2. The individual foldable elements 172 constructed in this manner may be formed into the decorative assembly as shown in FIG. 12 is made similarly to that described with reference to FIG. 5 to form an eight unit assembly having an appearance as shown in FIG. 12. Similarly, the foldable elements 172 may be used in other configurations of the decorative assembly as described herein.

Figure 14:
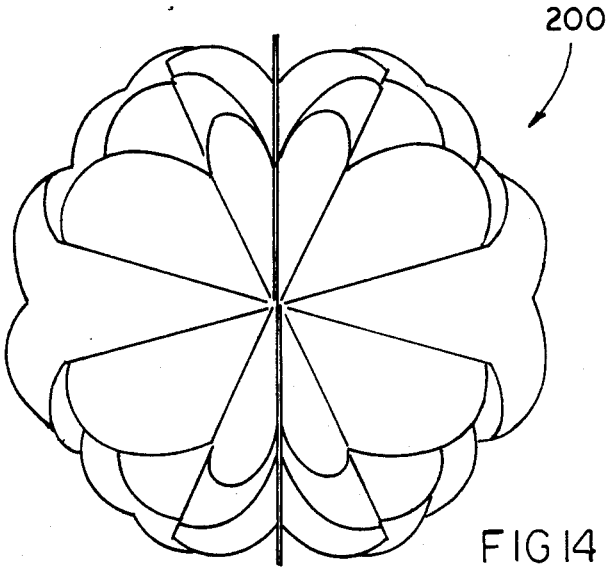
FIG. 14 is a top plan view of an alternate embodiment of the invention being a six unit formation of the decorative assembly shown in its open position for use.

Turning now to FIG. 14, a six unit decorative assembly 200 having a unique appearance is constructed from a plurality of discrete foldable elements or a continuous web as previously described.

Figure 15:
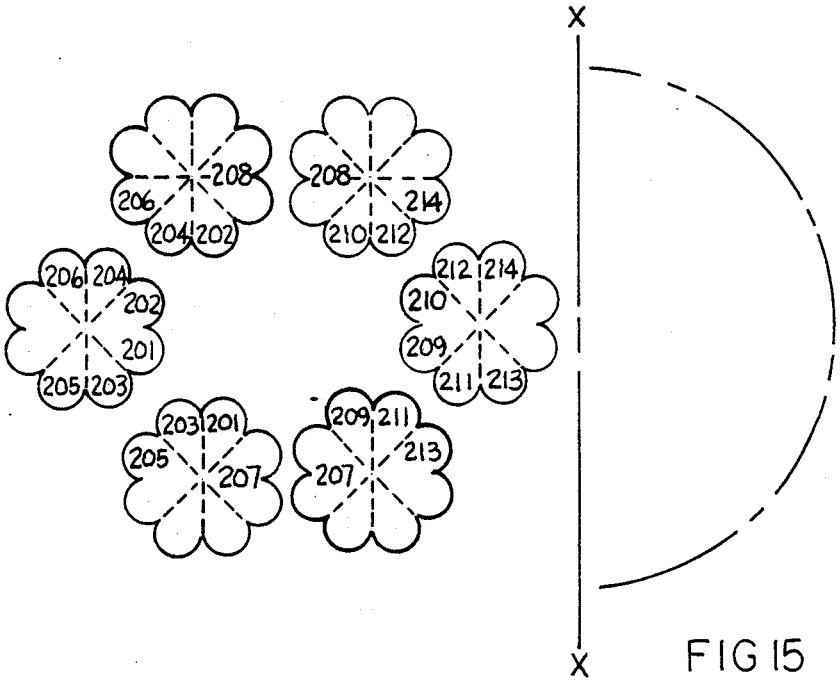
FIG. 15 is an exploded view illustration plurality of reduced size foldable elements showing the construction of the six unit assembly as shown in FIG. 14.

As seen in FIG. 15, the plurality of discrete foldable elements 202 are shown as they are arranged for forming the six unit configuration. Each of the elements 202 are secured to an adjacent foldable element by means of exterior faces formed by the fold lines of each element as previously described. The interior surfaces of the exterior faces have been indicated by reference numbers within each element 202, wherein like reference numbers indicate that these particular exterior surfaces are secured to one another to form the decorative assembly.

Figure 16:
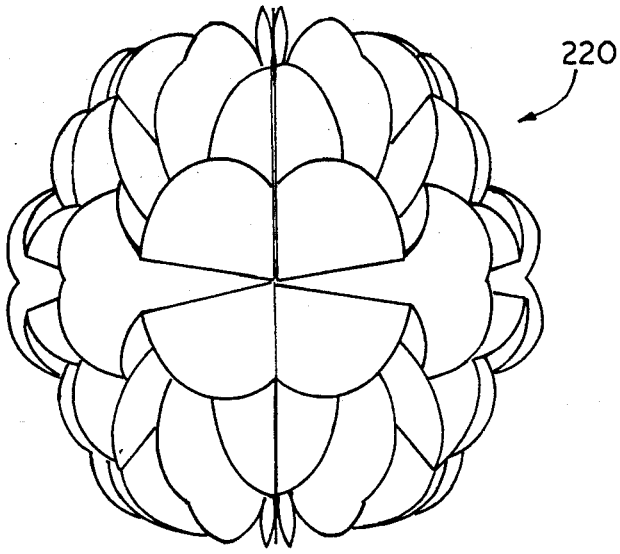
FIG. 16 is a top plan view of an alternate embodiment of the invention, showing a ten unit configuration in its open position for use.
Figure 17:
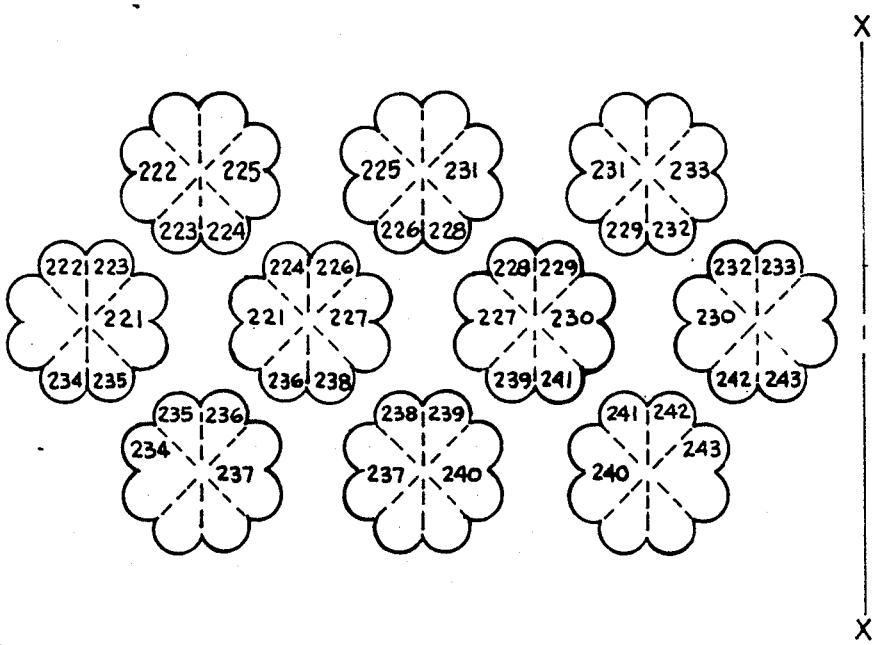
FIG. 17 is an exploded view illustrating a plurality of reduced size foldable elements showing the construction of the decorative assembly as shown in FIG. 16.
Figure 18:
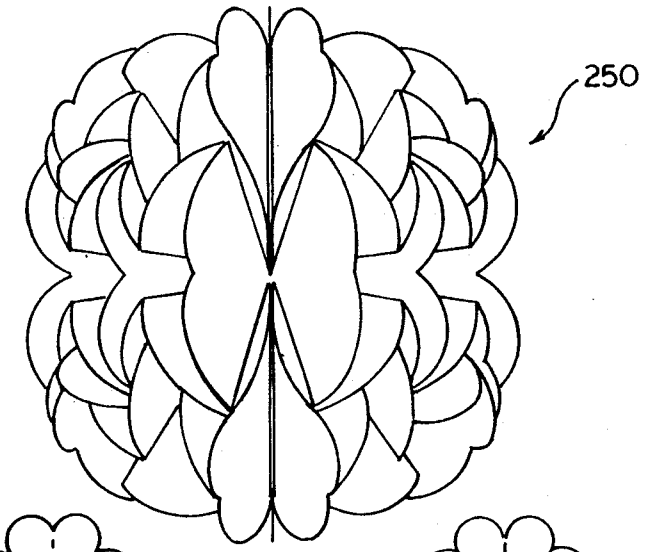
FIG. 18 is a top plan view of an alternate embodiment of the invention showing a 12 unit configuration in its open position for use.
Figure 19:
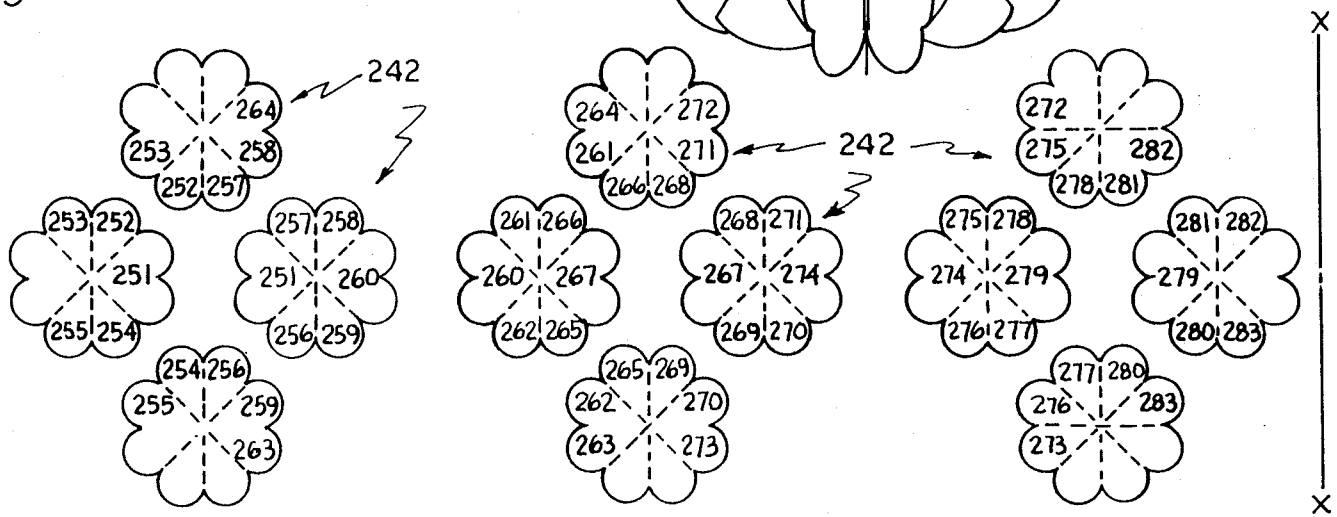
FIG. 19 is an exploded view illustrating a plurality of reduced size foldable elements showing the construction of the assembly as shown in FIG. 18.

Turning now to FIGS. 16–19, several other embodiments of the invention are shown giving an idea of the variety of appearance accomplished by the method of the invention. In FIGS. 16 and 18, ten and twelve unit assemblies 220 and 250 respectively yield unique appearance to the arrangement. As seen in FIGS. 17 and 19, the plurality of discrete foldable elements 222 and 242 respectively are shown as they are arranged for constructing the ten and twelve unit configurations. Each of the elements 222 and 242 are secured to an adjacent foldable element by means of exterior faces formed by the fold lines of each element as previously described. The interior surfaces of the exterior faces have been indicated by reference numbers within each element wherein like reference numbers indicate that these particular exterior surfaces are secured to one another to form the decorative assemblies.

As seen in FIG. 19, the twelve unit assembly comprises a plurality of rosettes constructed from four unit assemblies which are then secured to one another to yield the configuration as shown in FIG. 18. It should be recognized that additional foldable elements may be utilized to yield different and distinct appearances to the decorative assembly or be shaped so as to give the assembly a unique appearance.

Although the present invention has been described in terms of a particular preferred embodiment, it is contemplated that alterations and modifications of the assembly or method of forming the assembly will become apparent to those skilled in the art after having read the foregoing disclosure. Accordingly, it is to be understood that the particular apparatus described is for purposes of illustration only and appended claims are to interpreted as covering all modifications and alterations that fall within the true spirit and scope of the invention.

What is claimed is:

1. A method of forming a collapsible decorative assembly comprising:

forming a plurality of foldable elements from a flat sheet of flexible material which include positioned shaped portions on their peripheries;

inwardly folding said elements in a first direction so as to position adjacent ones of said shaped portions in overlapping relationship.

inwardly folding said elements in a second direction generally perpendicular to said first direction, outwardly folding said elements along a line bisecting diametrically opposed ones of said shaped portions such that the resulting fold lines enable said elements to be folded upon themselves with inwardly folded regions formed therein, positioning said folded elements adjacent one another wherein at least one of said inwardly folded regions is secured within and to one of said inwardly folded regions of an adjacent one of said elements to form a collapsible assembly in which said plurality of foldable elements act in conjunction with one another to at least partially open each of said foldable elements upon opening of said assembly and to collapse each of said foldable elements upon collapsing said assembly.

2. A method as in claim 1, wherein, said assembly is formed by positioning two of said elements in adjacent relationship and third and fourth of said elements positioned on opposite sides of said two adjacent elements, wherein said third and fourth elements each have at least one of said inwardly folded regions positioned in one of said inwardly folded regions of said two adjacent elements respectively to form a rosette.

3. A method as in claim 2, wherein said third and fourth elements are positioned at an angle relative to said two adjacent elements.

4. A method as in claim 1, wherein, said elements are secured to one another by means of an adhesive placed on predetermined exterior faces thereof.

5. A method as in claim 2, wherein,
said rosette is fastenable to another object by means of an adhesive tab.

6. A method as in claim 2, wherein,
a plurality of rosettes are secured to one another by means including at least one adhesive tab.

7. A method as in claim 1, wherein,
said elements have a plurality of exterior sides some of which are secured to predetermined ones of said sides of said adjacent one of said elements.

8. A method as in claim 1, wherein
said plurality of foldable elements are formed from a continuous web of material and are connected to one another, each of said elements being folded and positioned adjacent one another.

9. A method as in claim 8, wherein
said continuous web includes two of said elements connected in adjacent relationship and third and fourth of said elements positioned on opposite sides of said two adjacent elements wherein said third and fourth elements each have at least one of said inwardly folded regions to form a rosette.

10. A method as in claim 9, wherein
said rosette is connected to at least one other rosette to be secured in adjacent positions so as to be foldable to open and collapsed positions in conjunction with one another.

11. A method as in claim 8, wherein
an integral based portion is formed in said continuous web so as to secure said elements to one another in their folded positions.

12. A method as in claim 1, wherein
said assembly is formed by positioning first and second of said elements in adjacent relationship and third, fourth and fifth and sixth of said elements positioned on opposite sides of said first and second elements wherein said third, fourth, fifth and sixth of said elements have at least one of said inwardly folded regions positioned in one of said inwardly folded regions of said two adjacent elements.

13. A collapsible decorative assembly comprising;
a plurality of foldable elements constructed from a flat sheet of flexible material having symmetrically positioned shaped portions formed on the periphery thereof,
said elements having folds in first and second inward directions each of which positions adjacent ones of said shaped portions in overlapping relationship,
said elements also having an outward fold bisecting diametrically opposed ones of said shaped portions,
said outward fold enabling said diametrically opposed shaped portions to be folded upon themselves thereby forming inwardly folded regions in said elements,
said elements being positioned adjacent one another wherein at least one of said inwardly folded regions is secured within and to one of said inwardly folded regions of an adjacent one of said elements,
said plurality of elements being secured to one another to act in conjunction with one another to at least partially open each of said foldable elements upon opening of the assembly and to collapse each of said foldable elements upon collapsing of said assembly.

14. A collapsible assembly as in claim 13, wherein,
four of said elements are positioned in said adjacent relationship to form a rosette.

15. A collapsible assembly as in claim 14, wherein,
a plurality of said rosettes may be secured to one another and are foldable to open and collapsed positions in conjunction with one another.

16. A collapsible assembly as in claim 13, wherein,
said assembly is formed by positioning two of said elements in adjacent relationship and a third and fourth of said elements positioned on opposed edges of said two adjacent elements, wherein said third and fourth elements each have at least one of said inwardly folded regions positioned in one of said inwardly folded regions of said two adjacent elements respectively.

17. A collapsible assembly as in claim 13, wherein,
said elements have a plurality of exterior regions or faces which are secured to similar regions or faces of an adjacent one of said elements in a predetermined manner.

18. A collapsible assembly as in claim 13, wherein,
said plurality of elements include at least one adhesive tab for securing to another object or to itself.

19. A collapsible assembly as in claim 13, wherein,
said plurality of foldable elements are formed from a continuous web of material and are connected to one another, each of said elements being folded and positioned adjacent one another.

* * * * *